US009858904B1

(12) United States Patent
Gold

(10) Patent No.: US 9,858,904 B1
(45) Date of Patent: Jan. 2, 2018

(54) INSERTABLE PERCUSSION SYSTEM

(71) Applicant: Steven Gold, Tiburon, CA (US)

(72) Inventor: Steven Gold, Tiburon, CA (US)

( * ) Notice: Subject to any disclaimer, the term of this patent is extended or adjusted under 35 U.S.C. 154(b) by 0 days.

(21) Appl. No.: 15/662,477

(22) Filed: Jul. 28, 2017

Related U.S. Application Data

(63) Continuation-in-part of application No. 14/658,388, filed on Mar. 16, 2015, now Pat. No. 9,741,323.

(51) Int. Cl.
*G10D 13/02* (2006.01)
*G10D 13/00* (2006.01)
*G10D 13/06* (2006.01)

(52) U.S. Cl.
CPC ..... *G10D 13/026* (2013.01); *G10D 13/006* (2013.01); *G10D 13/029* (2013.01); *G10D 13/065* (2013.01)

(58) Field of Classification Search
CPC .. G10D 13/026; G10D 13/006; G10D 13/029; G10D 13/065
USPC ..... 84/421, 422.1, 422.3, 411 R, 411 P
See application file for complete search history.

(56) References Cited

U.S. PATENT DOCUMENTS 3,215,021 A * 11/1965 Kester, Jr. ..... G10D 13/021 84/411 M
3,433,115 A * 3/1969 Kjelstrom ..... G10D 13/00 84/411 M
3,464,305 A * 9/1969 Meazzi ..... G10D 13/065 84/422.3
3,742,810 A * 7/1973 Crigger ..... G10D 13/065 84/422.3
3,747,464 A * 7/1973 Russell ..... G10D 13/006 84/422.1
3,893,363 A * 7/1975 Cohen ..... G10D 13/00 248/124.1
4,111,095 A * 9/1978 Simons ..... G10D 13/065 248/125.1
4,337,684 A * 7/1982 Le Mert ..... G10D 13/00 84/421

(Continued)

FOREIGN PATENT DOCUMENTS

JP 2007206489 A 8/2007

OTHER PUBLICATIONS

Non-final Office Action in co-pending U.S. Appl. No. 14/658,388 dated Jun. 29, 2016.

(Continued)

*Primary Examiner* — David Warren
*Assistant Examiner* — Christina Schreiber
(74) *Attorney, Agent, or Firm* — Renner, Otto, Boisselle & Sklar, LLP

(57) ABSTRACT

A drumming system includes a percussion instrument; an inserting/retracting coupled to the percussion instrument for moving the first percussion instrument to a desired position with respect to a second percussion instrument; the inserting/retracting mechanism including a motor, an input device for receiving an operation instruction and generating an operation signal based on the operation instruction, a feedback mechanism for obtaining position information of the first percussion instrument and generating a feedback signal representative of the position information, and a controller electrically coupled to the input device, the motor, and the feedback mechanism for actuating the motor based on the operation signal and the feedback signal.

12 Claims, 18 Drawing Sheets

(56) References Cited

U.S. PATENT DOCUMENTS 4,449,440 A * 5/1984 Hoshino ..... G10D 13/065 84/422.3
4,453,446 A * 6/1984 Hoshino ..... G10D 13/026 84/421
4,491,050 A * 1/1985 Franzmann ..... G10C 3/14 84/746
4,987,817 A * 1/1991 Diaz ..... G10D 13/06 84/421
5,063,821 A * 11/1991 Battle ..... G10H 1/32 84/411 R
5,192,822 A * 3/1993 Hoshino ..... G10D 13/065 84/421
5,267,500 A * 12/1993 Lombardi ..... G10D 13/065 84/402
5,789,688 A * 8/1998 Schiano ..... G10D 13/006 84/422.1
5,803,642 A * 9/1998 Sassmannshausen ..... F16C 11/0604 248/124.1
5,990,401 A * 11/1999 Braun ..... G10D 13/006 84/104
6,307,136 B1 * 10/2001 Sikra ..... G10D 13/006 84/422.1
6,528,714 B1 * 3/2003 Liao ..... G10D 13/065 84/422.1
6,822,150 B1 * 11/2004 Lombardi ..... G10D 13/065 84/422.1
6,825,407 B1 * 11/2004 Curren ..... G10D 13/06 84/402
7,074,997 B2 * 7/2006 Steele ..... G10D 13/006 84/422.1
7,094,959 B2 * 8/2006 Marnell ..... G10D 13/065 84/422.1
7,232,947 B1 * 6/2007 Lombardi ..... G10D 13/065 84/327
7,339,103 B2 * 3/2008 Hilburn ..... G10D 13/006 200/86.5
7,342,163 B2 * 3/2008 O'Donnell ..... G10D 13/065 84/422.3
7,348,480 B1 * 3/2008 Liao ..... G10D 13/065 84/422.1
7,351,902 B1 * 4/2008 Sikra ..... G10D 13/065 84/422.1
7,468,480 B1 * 12/2008 Sikra ..... G10D 13/026 84/421
7,528,312 B1 * 5/2009 DiGiovanni ..... G10D 13/02 84/411 R
7,655,854 B1 * 2/2010 Wang ..... G10D 13/065 84/421
7,804,015 B1 * 9/2010 Wilson ..... G10D 13/06 84/422.1
8,178,769 B2 * 5/2012 Steele ..... G10D 13/006 84/421
8,292,250 B2 * 10/2012 Jines ..... A47B 19/002 108/176
8,754,314 B1 * 6/2014 Bachman, III ..... G10D 13/065 84/422.1
8,927,842 B1 * 1/2015 Honjo ..... G10D 13/026 84/411 R
8,940,989 B1 * 1/2015 Spriggel ..... G10D 13/065 84/422.3
9,093,053 B2 * 7/2015 Jungeberg ..... G10G 7/00
9,208,761 B2 * 12/2015 Miyajima ..... G10D 13/06
9,214,142 B2 * 12/2015 May ..... G10G 5/005
2004/0025664 A1 * 2/2004 Bennett ..... G09B 15/00 84/411 P
2005/0121565 A1 * 6/2005 Johnson ..... F16M 11/18 248/125.1
2005/0150355 A1 * 7/2005 Sutej ..... G10D 13/065 84/422.3
2005/0172784 A1 * 8/2005 Lee ..... G10D 13/006 84/422.1
2005/0211058 A1 * 9/2005 Crane ..... G10D 13/00 84/402
2005/0284283 A1 * 12/2005 May, Jr. ..... G10D 13/029 84/411 P
2006/0207408 A1 * 9/2006 Steele ..... G10D 13/006 84/422.1
2008/0072737 A1 * 3/2008 Steele ..... G10D 13/006 84/422.1
2008/0229902 A1 * 9/2008 Mori ..... G10D 13/00 84/421
2009/0229444 A1 * 9/2009 Measelle ..... G10D 13/025 84/421
2012/0006178 A1 * 1/2012 Steele ..... G10D 13/006 84/421
2014/0116229 A1 * 5/2014 Mori ..... G10D 13/02 84/415
2016/0005386 A1 * 1/2016 Mori ..... G10D 13/026 84/421
2016/0275923 A1 * 9/2016 Gold ..... G10D 13/026

OTHER PUBLICATIONS

Final Office Action in co-pending U.S. Appl. No. 14/658,388 dated Dec. 30, 2016.
International Preliminary Report on Patentability in corresponding International application No. PCT/US2016/022631 dated Sep. 19, 2017.
Written Opinion of the International Searching Authority in corresponding International application No. PCT/US2016/022631 dated Jun. 14 ,2016.
International Search Report in corresponding International application No. PCT/US2016/022631 dated Jun. 14, 2016.

* cited by examiner

INSERTABLE PERCUSSION SYSTEM

FIELD OF THE INVENTION

The present invention relates to percussion instruments, and particularly to a system for inserting and retracting percussion instruments.

DESCRIPTION OF THE RELATED ART

Percussion sets have been developed that produce a large variety of different sounds. Percussion sets may include, for example, drums, cymbals, bells, cowbells, hi-hats, tambourines, wood blocks, etc. Even among drums a large variety of different drums exists such as, for example, kettle drums, steel drums, bongo drums, tom-toms, bass drums, tenor drums, snare drums, etc. To add to the abundance of sounds produced by these different percussion instruments, different techniques (e.g., rim shots, etc.) for striking or beating these percussion instruments have been developed to obtain different sounds from any one instrument.

Conventionally, however, percussion instruments were located relative to the player (i.e., the percussionist) at fixed positions. Since the instruments take space, there was a limit in the amount of instruments that may form part of any one percussion set. Moreover, the fixed locations of each of the instruments limited the number of sounds that the percussion set could produce.

BRIEF SUMMARY OF THE INVENTION

The invention disclosed herein provides a system for inserting and retracting percussion instruments from a percussion set. Using the systems disclosed herein players are able to produce broader ranges of sounds and rhythms because different arrangements of percussion instruments may be available to the percussionist as the percussionist is playing that otherwise would not be available.

Moreover, an arrangement may be set where, for example, drum beats occur from striking a first drum downwardly and a second drum, that has been inserted above the first drum by use of the systems disclosed herein, upwardly. This way, the percussionist may double the amount of resulting drum beats; i.e., the conventional beats from the downward strikes plus the beats that result from the upward strikes.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
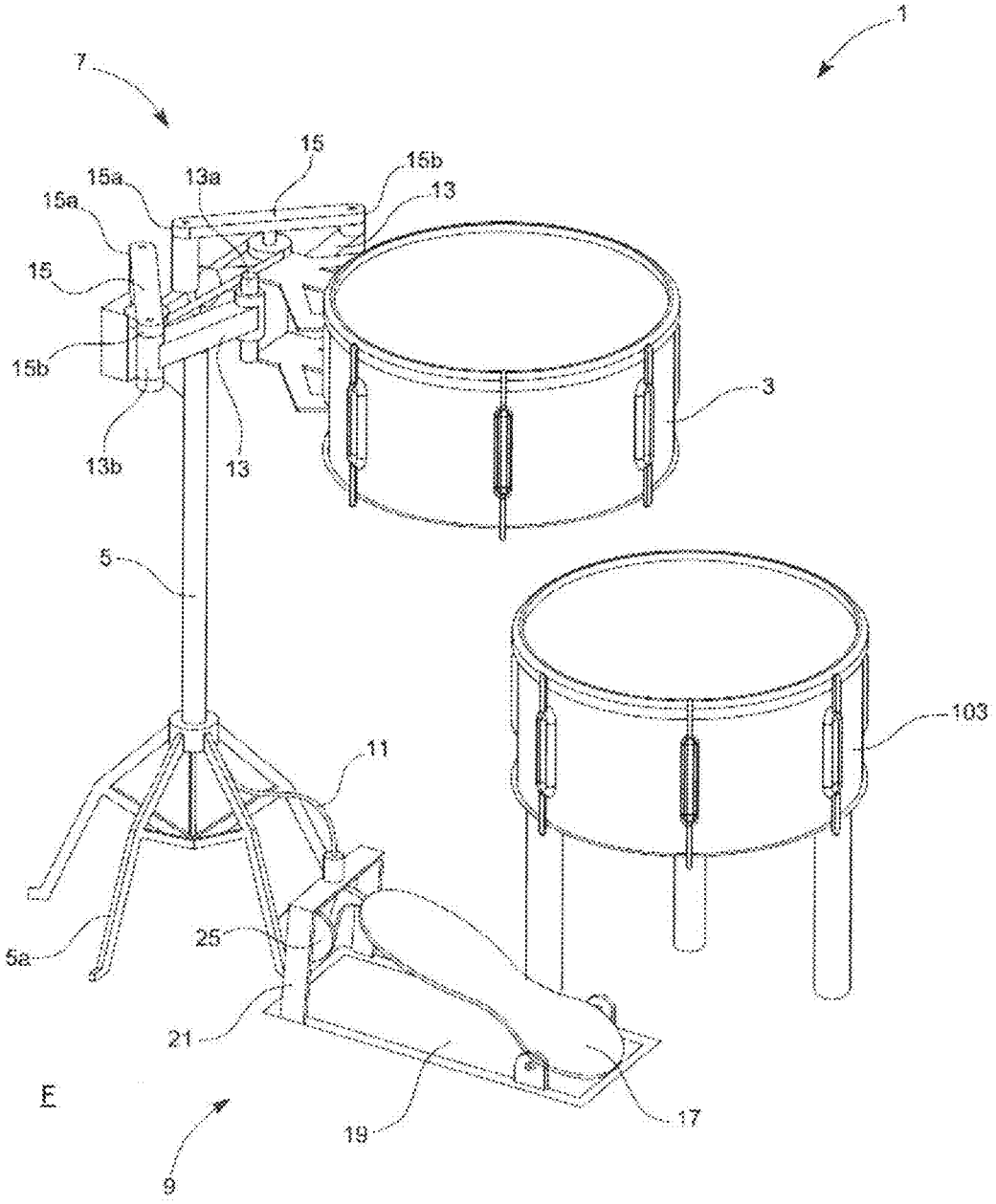
FIG. 1 illustrates a perspective view of an exemplary insertable percussion system in the retracted position.
Figure 2A:
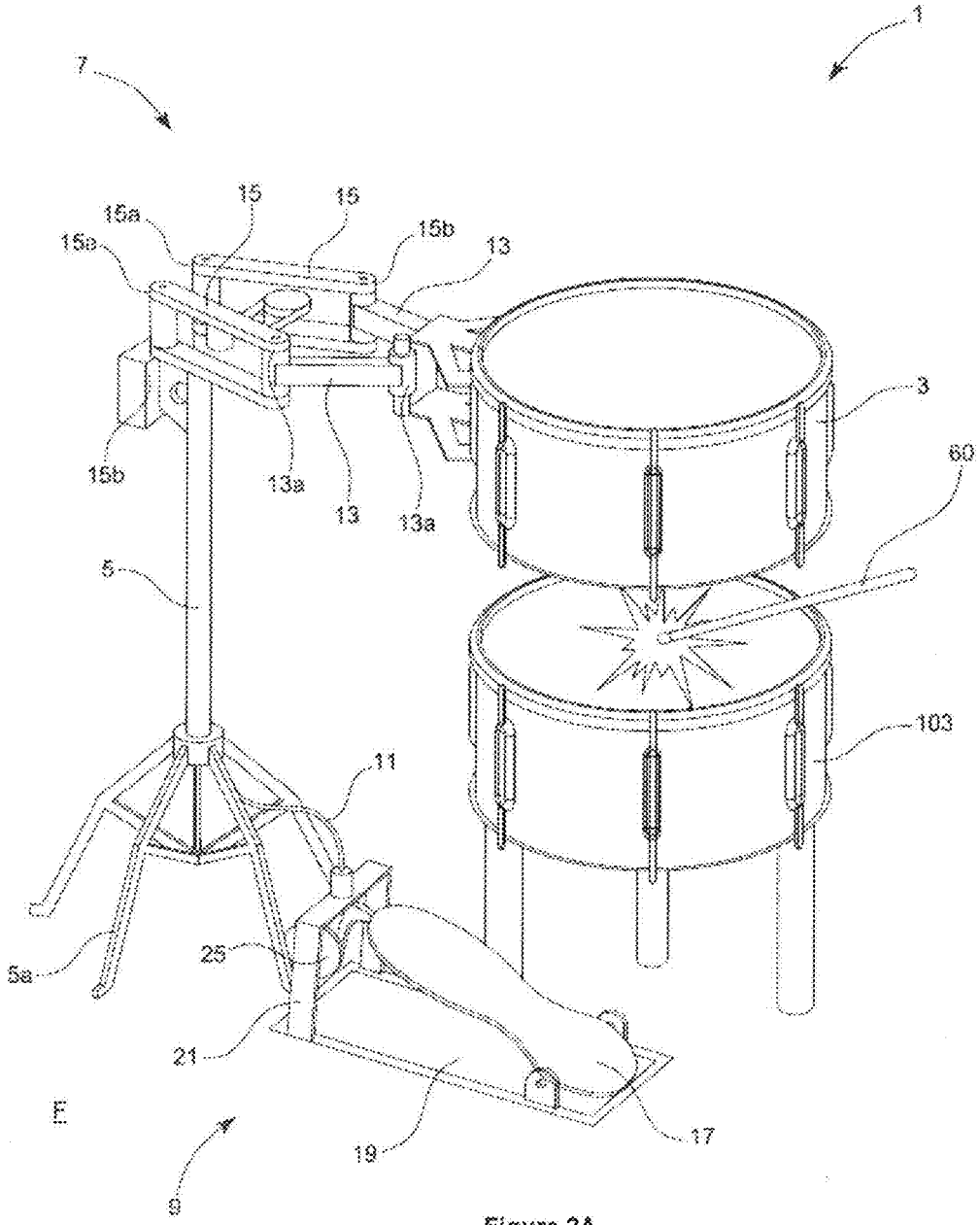
FIG. 2A illustrates a top perspective view of the exemplary insertable percussion system of FIG. 1 in the inserted position.
Figure 2B:
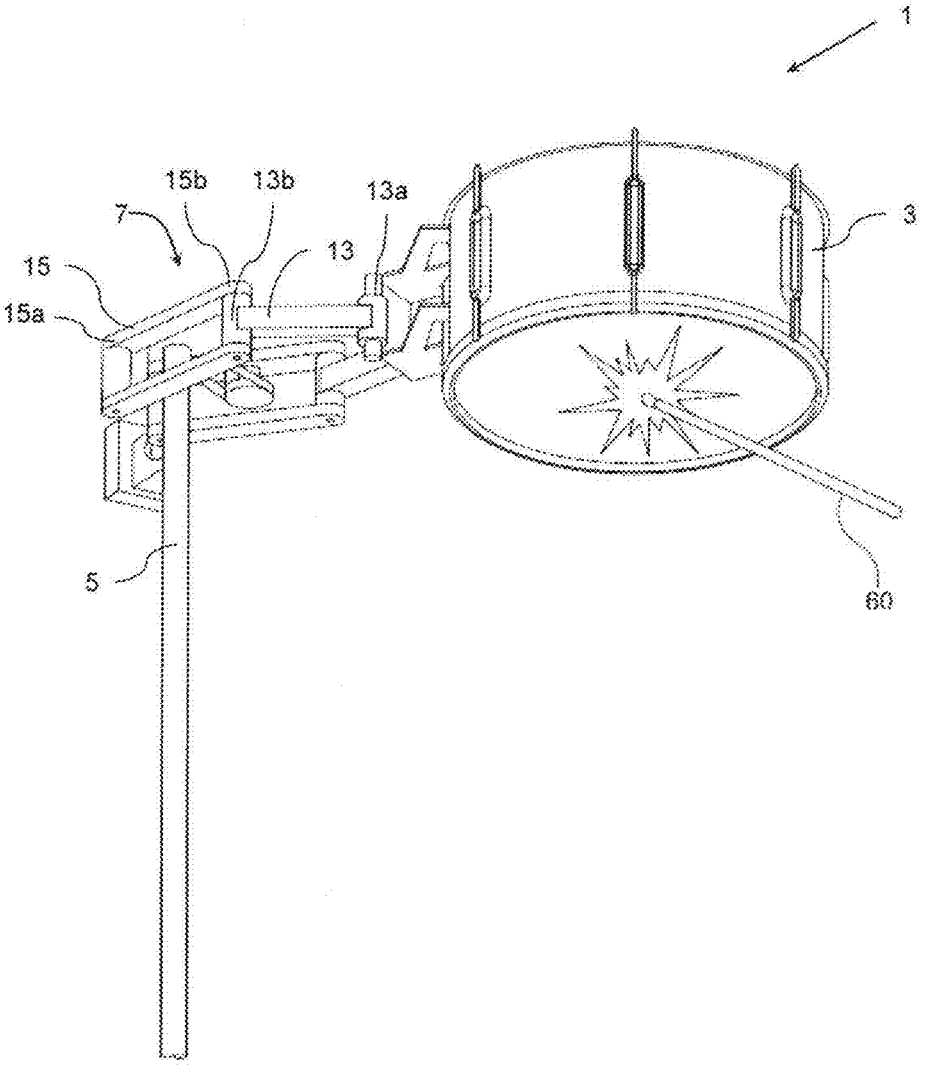
FIG. 2B illustrates a bottom perspective view of the exemplary insertable percussion system of FIG. 1 in the inserted position.

FIGS. 1, 2A and 2B illustrate perspective views of an exemplary insertable percussion system 1. The system 1 includes a percussion instrument 3. In the illustrated embodiment, the percussion instrument 3 corresponds to a drum. In other embodiments, the percussion instrument 3 may correspond to percussion instruments different from a drum. The insertable percussion system 1 also includes a stand 5 that has a base or feet 5*a* for sustaining the stand 5 off a floor F. The stand 5 generally sustains the percussion instrument 3 vertically off the floor F.

The insertable percussion system 1 also includes an inserting/retracting mechanism 7 connected to the percussion instrument 3 and the stand 5. The system 1 also includes a pedal 9 disposed on the floor F at or near the base 5*a* of the stand 5. The stand 5 vertically separates the percussion instrument 3 and the inserting/retracting mechanism 7 from the pedal 9. The insertable percussion system 1 also includes a cable 11 that connects the pedal 9 to the inserting/retracting mechanism 7. Operation (i.e., pressing and releasing) of the pedal 9 up or down causes the pedal 9 to pull and release on the cable 11 which, in turn, causes the inserting/retracting mechanism 7 to move the percussion instrument 3 substantially horizontally.

Pressing down on the pedal 9 causes the pedal 9 to pull on the cable 11 which, in turn, causes the inserting/retracting mechanism 7 to move the percussion instrument 3 substantially horizontally from a retracted position as shown in FIG.

1 to an inserted position as shown in FIGS. 2A and 2B. Releasing up on the pedal 9 causes the pedal 9 to release on the cable 11 which, in turn, causes the inserting/retracting mechanism 7 to move the percussion instrument 3 substantially horizontally from the inserted position shown in FIGS. 2A and 2B back to the retracted position of FIG. 1.

In one embodiment, the insertable percussion system 1 as shown in FIGS. 1, 2A and 2B forms part of a drum or percussion set. In the percussion set, the percussion instrument 3 may be inserted by operation of the pedal 9 as described above to make the percussion instrument 3 temporarily available to the percussionist to play. The percussion instrument 3, for example, may be inserted above another instrument 103 in the percussion set to make the percussion instrument 3 available to the percussionist for playing instead of the other instrument 103. Whenever the percussionist is ready to return to playing the other instrument 103, the percussionist may remove or retract the percussion instrument 3 by operation of the pedal 9 to make the other instrument available for the percussionist to play.

In one embodiment, the insertable percussion system 1 as shown in FIGS. 1, 2A and 2B forms part of a drum or percussion set including another percussion instrument 103 intended to be played by being hit with a downstroke or downward motion of a beater or a drum stick 60, as shown in FIG. 2A. In this embodiment, the percussion instrument 3 may be intended to be played by being hit with an upstroke or upward motion of the beater or the drum stick 60, as shown in FIG. 2B. In this setting, the percussion instrument 3 may be inserted above the downstroke percussion instrument 103 to make the percussion instrument 3 available to the percussionist for playing in the upstroke in combination with the downstroke percussion instrument 103. By operation of the pedal 9, the percussion instrument 3 may be moved horizontally into the inserted position above the downstroke percussion instrument 103.

In another embodiment, the roles are reversed; i.e., the percussion instrument 3 may be intended to be played by being hit with a downstroke or downward motion of the beater or the drum stick and the percussion instrument 3 is inserted under or below an upstroke percussion instrument.

The percussionist may strike the downstroke percussion instrument 103 in the downstroke motion and the upstroke percussion instrument in the proceeding (i.e., immediately after) upstroke motion. This way, the percussionist may double the amount of resulting drum beats; i.e., the conventional beats from the downward strikes plus the beats that result from the upward strikes of the percussion instrument 3. Whenever the percussionist is ready to conclude playing in this upstroke/downstroke mode, the percussionist may remove or retract the percussion instrument 3 by operation of the pedal 9.

In the upstroke/downstroke embodiment above, the inserted position of the insertable percussion system 1 may correspond to a position where a majority of a playing surface of the upstroke drum (e.g., the skin of the percussion instrument 3) faces or vertically overlaps a majority of a playing surface of the downstroke drum 103. The retracted position of the insertable percussion system 1, on the other hand, may correspond to a position where the majority of the playing surface of the upstroke drum (e.g., the skin of the percussion instrument 3) does not face or does not vertically overlap the majority of the playing surface of the downstroke drum 103. In the illustrated embodiment, the inserting/retracting mechanism 7 includes a first arm 13 and a second arm 15.

Figure 3:
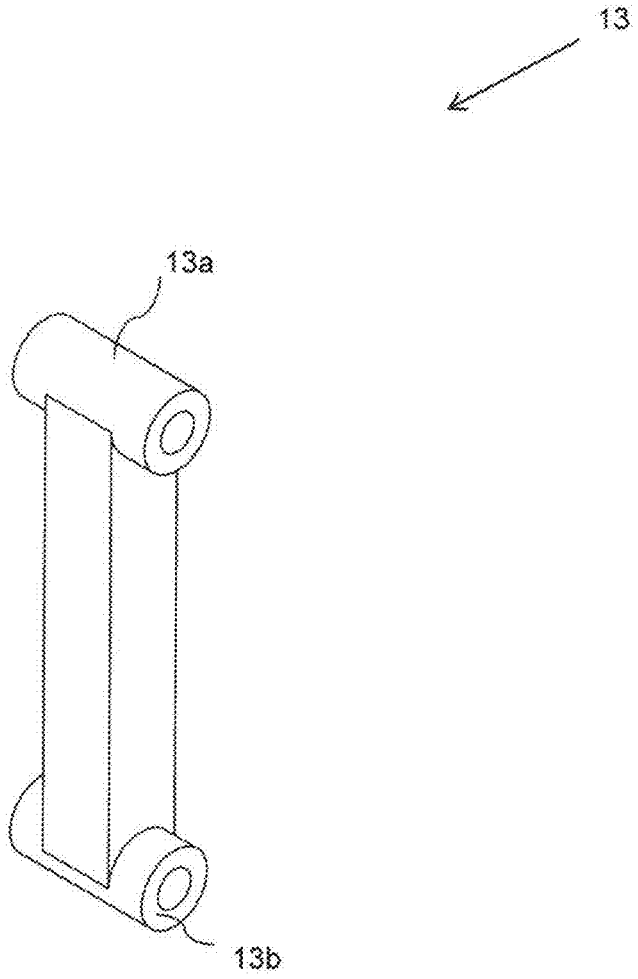
FIG. 3 illustrates a perspective view of an exemplary first arm of the insertable percussion system of FIG. 1.

FIG. 3 illustrates a perspective view of an exemplary first arm 13. The first arm 13 includes a percussion instrument end 13*a* that operably and rotably connects to the percussion instrument 3 as shown in FIGS. 1 and 2. The first arm 13 also includes a joint end 13*b* that is distal the percussion instrument 3. The joint end 13*b* operably and rotably connects to the second arm 15.

Figure 4:
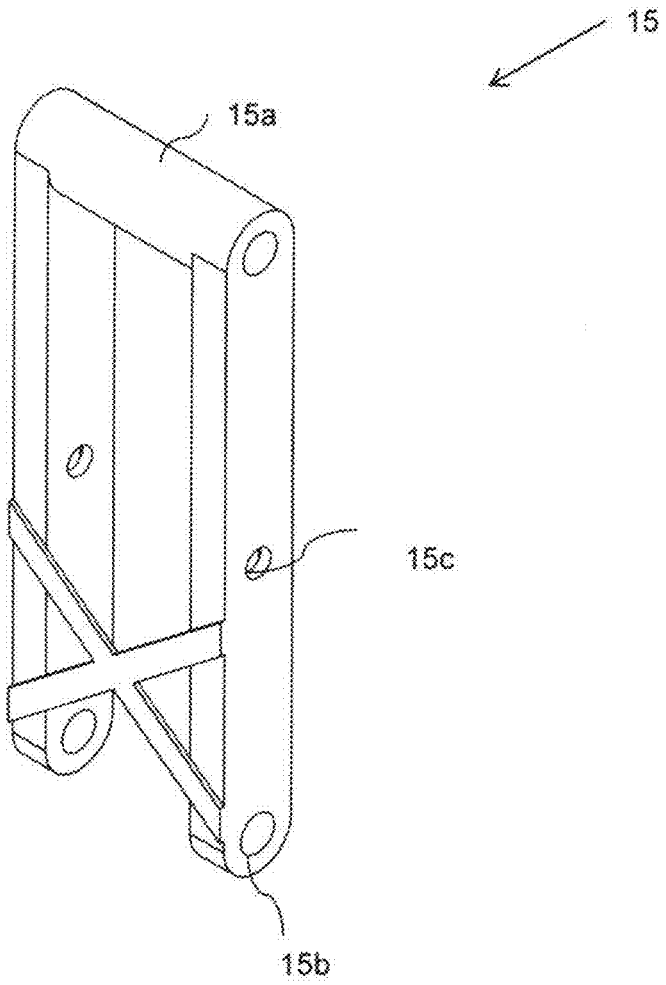
FIG. 4 illustrates a perspective view of an exemplary second arm of the insertable percussion system of FIG. 1.

FIG. 4 illustrates a perspective view of an exemplary second arm 15. The second arm 15 includes a stand end 15*a* that operably and rotably connects to the stand 5. The second arm 15 also includes a joint end 15*b* that is distal to the stand 5 and that operably and rotably connects to the joint end 13*b* of the first arm 13. The second arm 15 may also include a pull position 15*c* at which the second arm 15 may be operably connected to the cable 11.

Pulling of the cable 11 by operation of the pedal 9 causes the second arm 15 to rotate about the stand end 15*a* and the joint end 15*b*, and the first arm 13 to rotate about the joint end 13*b* and the percussion instrument end 13*a* to effectively stretch the inserting/retracting mechanism 7 causing the percussion instrument 3 to move horizontally away from the stand 5 to the inserted position.

Releasing of the cable 11 by operation of the pedal 9 causes the second arm 15 to, in opposite direction as in the inserting, rotate about the stand end 15*a* and the joint end 15*b*, and the first arm 13 to rotate about the joint end 13*b* and the percussion instrument end 13*a* to effectively contract the inserting/retracting mechanism 7 causing the percussion instrument 3 to move horizontally towards the stand 5 to the retracted position.

In the illustrated embodiment of FIGS. 1 and 2, the insertable percussion system 1 includes two first arms 13 each having a percussion instrument end 13*a* proximate the percussion instrument 3 and a joint end 13*b* distal the percussion instrument 3. In this embodiment, the insertable percussion system 1 also includes two second arms 15, each having a stand end 15*a* proximate the stand 5 and a joint end 15*b* distal the stand 5. In this embodiment, each of the joint ends 13*b* of the first arms is rotably connected to a respective one of the joint ends 15*b* of the second arm, and each of the first arms 13 is rotable about its percussion instrument end 13*a* and about its joint end 13*b*, and each of the second arms 15 is rotable about its stand end 15*a* and about its joint end 15*b* to stretch or contract the inserting/retracting mechanism 7 into the inserted position or the retracted position.

In one embodiment (not shown), the inserting/retracting mechanism 7 includes a spring configured in the inserting/retracting mechanism 7 to bias the inserting/retracting mechanism 7 towards retraction (i.e., in the retracted position). In this embodiment, pulling of the cable 11 by operation of the pedal 9 defeats tension force in the spring extending the spring and causing the second arm 15 to rotate about the stand end 15*a* and the joint end 15*b*, and the first arm 13 to rotate about the joint end 13*b* and the percussion instrument end 13*a* to effectively stretch the inserting/retracting mechanism 7 causing the percussion instrument 3 to move horizontally away from the stand 5 to the inserted position. Releasing of the cable 11 by operation of the pedal 9 allows tension force in the extended spring to retract the inserting/retracting mechanism 7 into the retracted position such that the percussion instrument 3 is moved horizontally towards the stand 5.

Figure 5:
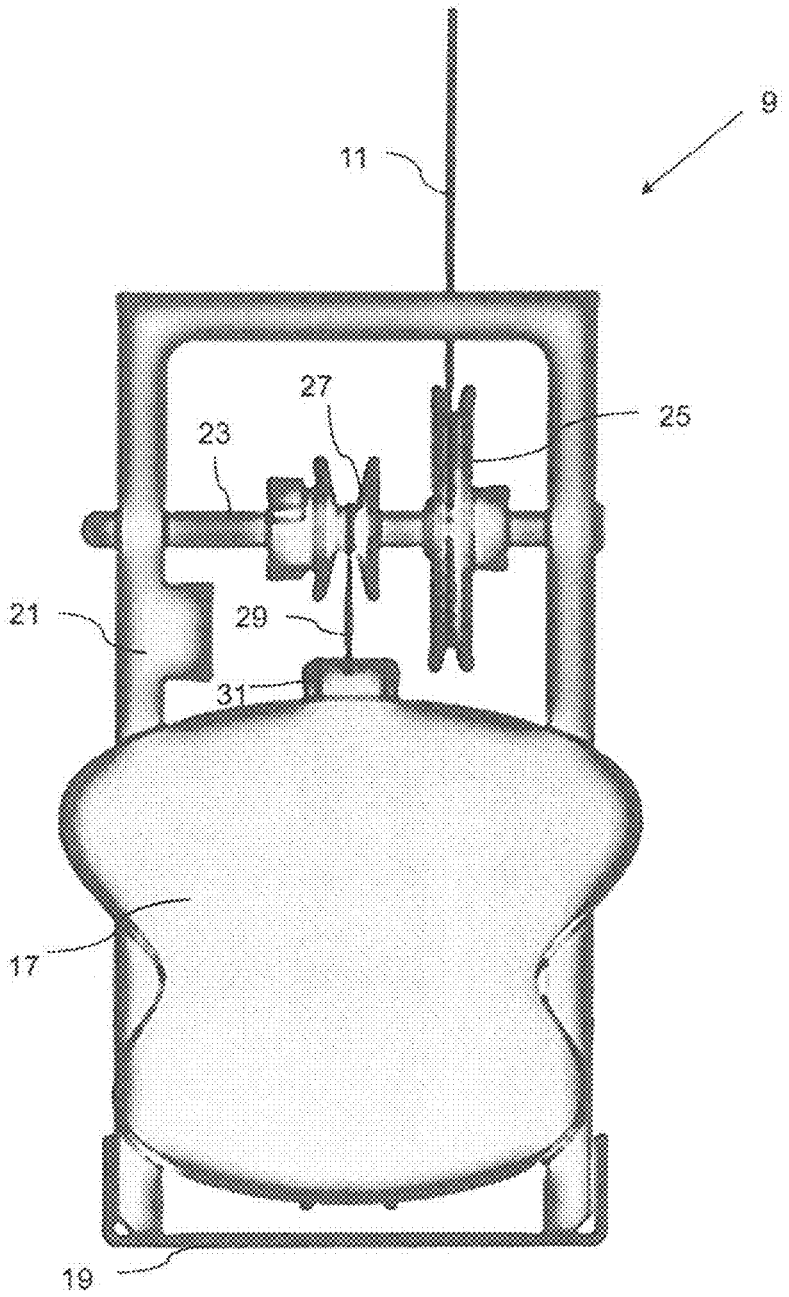
FIG. 5 illustrates a front view of an exemplary pedal for the insertable percussion system of FIG. 1.
Figure 6:
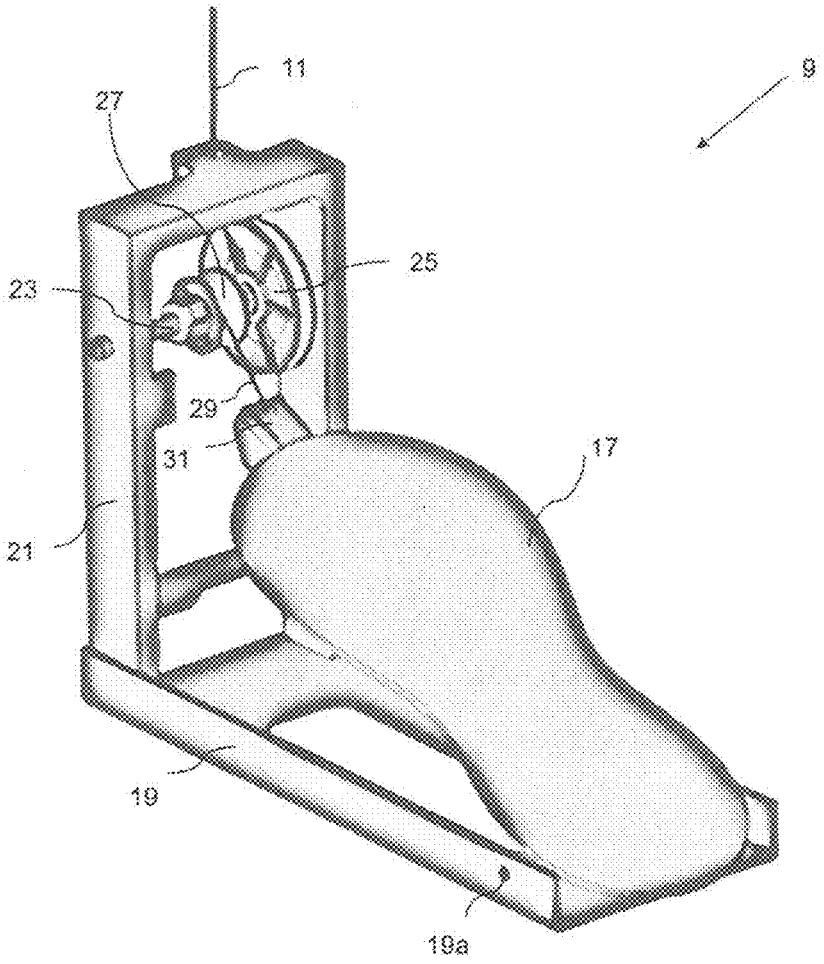
FIG. 6 illustrates a perspective view of the exemplary pedal for the insertable percussion system of FIG. 1.
Figure 7:
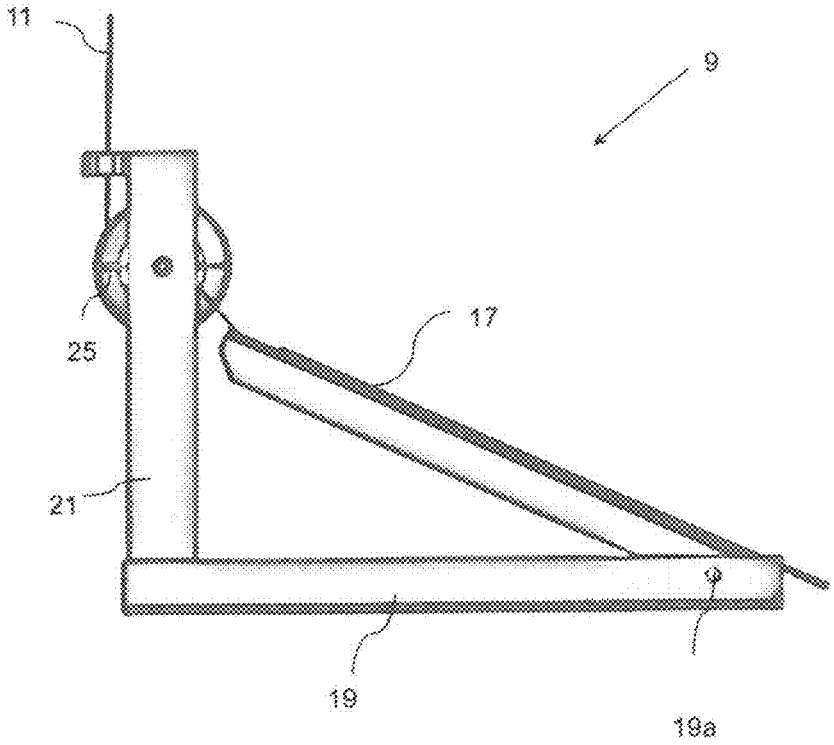
FIG. 7 illustrates a side view of the exemplary pedal for the insertable percussion system of FIG. 1.

FIGS. 5-7 illustrate front, perspective and side views, respectively, of an exemplary pedal 9 for the insertable percussion system 1. The pedal 9 may include a foot platform 17 rotably connected to a base 19 at a rotating location 19*a*. The foot platform 17 receives a foot or shoe of the person playing the insertable percussion system 1. The pedal 9 may also include a rising portion 21 that may have installed therein a rod 23 and cable wheels 25 and 27 that rotate about the rod 23. The cable wheel 27 is connected to the foot platform 17 by a cable 29. The cable wheel 25 connects to the cable 11 which, as described above, connects to the inserting/retracting mechanism 7.

Pressing of the foot or shoe of the person playing the insertable percussion system 1 causes the foot platform 17 to rotate about the rotating location 19*a*. This rotation pulls on the cable 29 which causes the rod 23 and the cable wheel 25 to also rotate effectively pulling on the cable 11 and stretching the inserting/retracting mechanism 7 into the inserted position.

Releasing of the foot or shoe of the person playing the insertable percussion system 1 causes the foot platform 17 to rotate, in the opposite direction as insertion, about the rotating location 19*a*. This opposite rotation releases the cable 29 which causes the rod 23 and the cable wheel 25 to also rotate effectively releasing on the cable 11 and retracting the inserting/retracting mechanism 7 into the retracted position.

Figure 8:
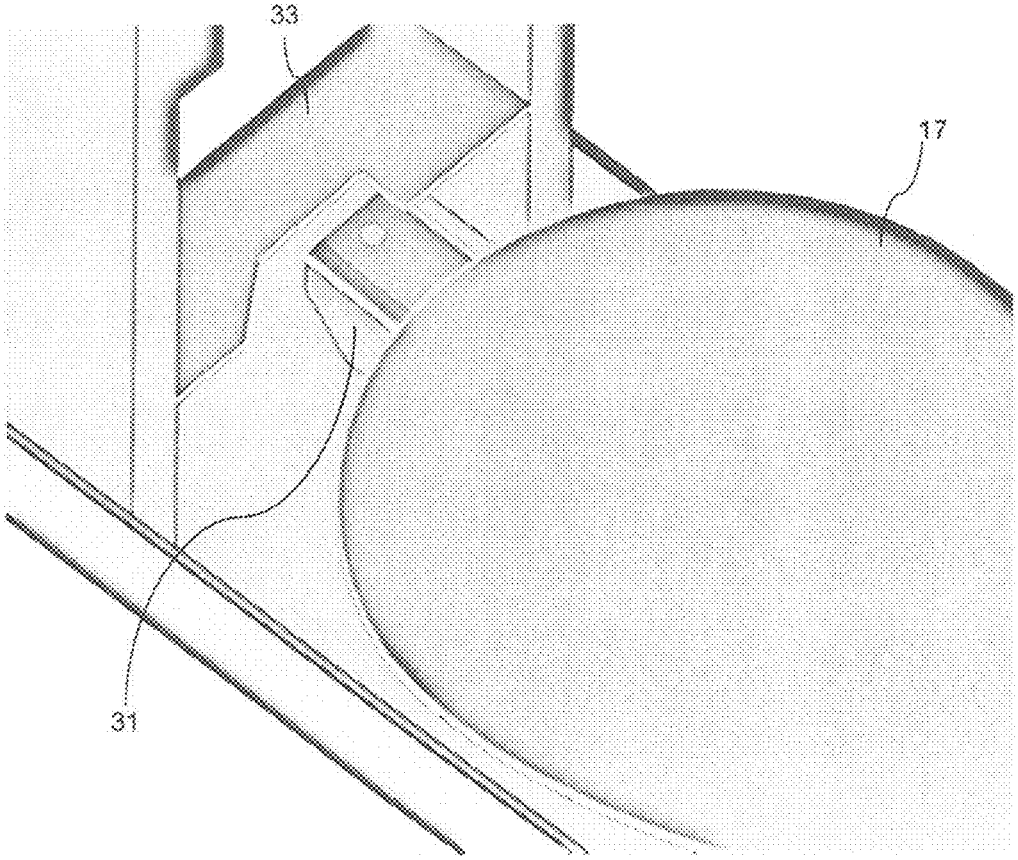
FIG. 8 illustrates a magnified view of the exemplary pedal for the insertable percussion system of FIG. 1 illustrating a latching mechanism.

FIG. 8 illustrates a magnified view of the exemplary pedal 9. Specifically, FIG. 8 illustrates a locking or latching mechanism of the foot platform 17 while pressed. While pressed, the player or percussionist may move the foot platform 17 laterally or sideways to engage a latching tab 31 connected to the foot platform 17 to a latching bracket 33 connected to the rising portion 21. This effectively latches the inserting/retracting mechanism 7 in the inserted position.

When the player or percussionist desires to retract the percussion instrument 3 to the retracted position, the player or percussionist may move the foot platform 17 laterally or sideways in the opposite direction as engagement to disengage the latching tab 31 from the latching bracket 33. The player or percussionist may then release his foot or shoe from the foot platform 17 to retract the inserting/retracting mechanism 7 into the retracted position.

Figure 9:
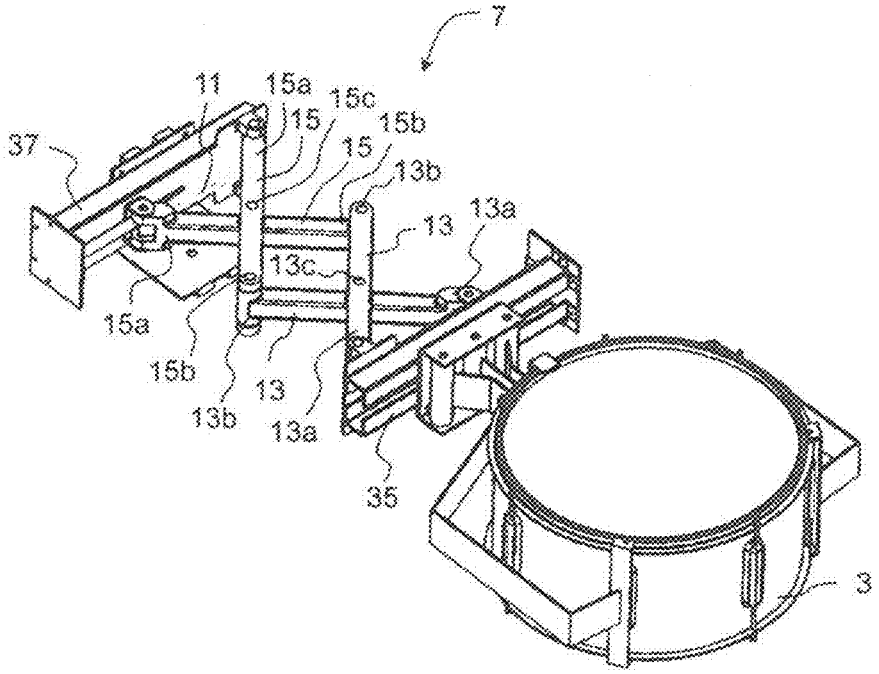
FIG. 9 illustrates a perspective view of an exemplary insertion/extraction mechanism.
Figure 10:
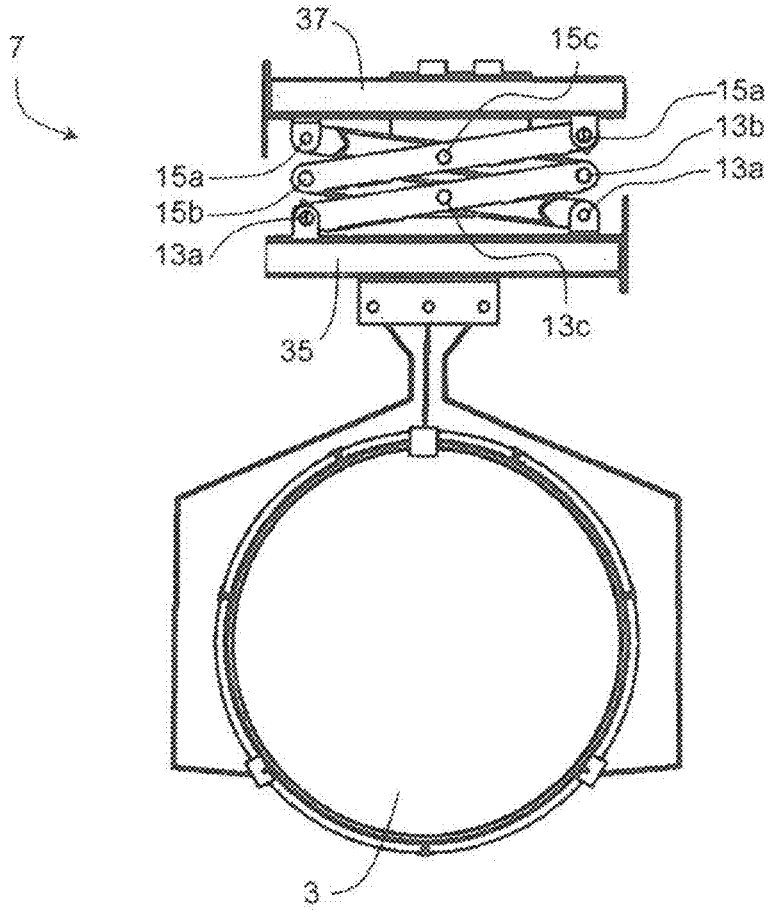
FIG. 10 illustrates a top view of the exemplary insertion/extraction mechanism of FIG. 9 in the extracted position.
Figure 11:
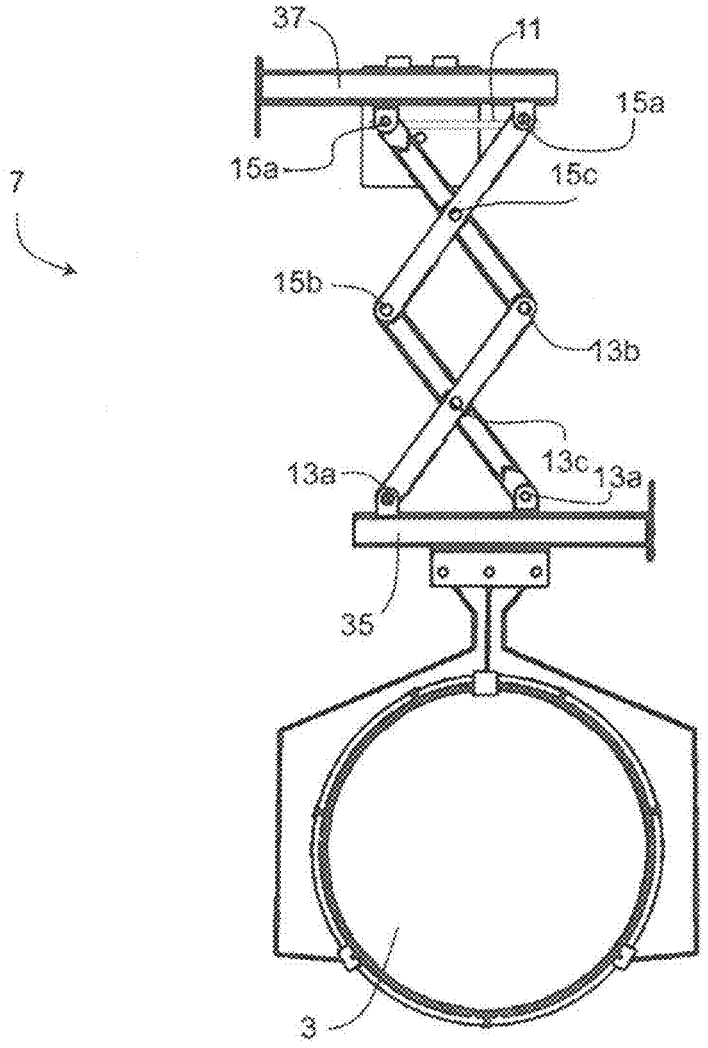
FIG. 11 illustrates a top view of the exemplary insertion/extraction mechanism of FIG. 9 in the inserted position.

FIGS. 9-11 illustrate a second embodiment of the inserting/retracting mechanism 7 for the insertable percussion system 1. In the embodiment of FIG. 9, the inserting/retracting mechanism 7 includes the first arm 13 and a second arm 15, which are similar to the first arm 13 and the second arm 15 of the first embodiment except that, in this second embodiment, the first arm 13 and the second arm 15 crisscross resulting in insertion and retraction of the inserting/retracting mechanism 7 to have a scissoring effect.

The first arm 13 includes a percussion instrument end 13*a* that operably and rotably connects to the percussion instrument 3. In the illustrated embodiment, the exemplary insertable percussion system 1 includes a slide bracket 35 that operably and rotably connects the percussion instrument end 13*a* to the percussion instrument 3. The first arm 13 also includes a joint end 13*b* that is distal the percussion instrument 3. The joint end 13*b* operably and rotably connects to the second arm 15.

The second arm 15 includes a stand end 15*a* that operably and rotably connects to the stand 5. In the illustrated embodiment, the exemplary insertable percussion system 1 includes a slide bracket 37 that operably and rotably connects the stand end 15*a* to the stand 5. The stand end 15*a* of the second arm 15 may be connected to the cable 11. The second arm 15 also includes a joint end 15*b* that is distal to the stand 5 and that operably and rotably connects to the joint end 13*b* of the first arm 13.

In the illustrated embodiment of FIGS. 9-11, the insertable percussion system 1 includes two first arms 13 each having a percussion instrument end 13*a* proximate the percussion instrument 3, a joint end 13*b* distal the percussion instrument 3, and a joint position 13*c*. In this embodiment, the insertable percussion system 1 also includes two second arms 15, each having a stand end 15*a* proximate the stand 5, a joint end 15*b* distal the stand 5, and a joint position 15*c*. In this embodiment, each of the joint ends 13*b* of the first arms 13 is rotably connected to a respective one of the joint ends 15*b* of the second arm, each of the joint positions 13*c* of the first arm 13 is operably and rotably connected to the joint position 13*c* of the other first arm 13, and each of the joint positions 15*c* of the second arm 15 is operably and rotably connected to the joint position 15*c* of the other first arm 15. Each of the first arms 13 is rotable about its percussion instrument end 13*a*, about its joint end 13*b*, and about its joint position 13*c*. Each of the second arms 15 is rotable about its stand end 15*a*, about its joint end 15*b*, and about its joint position 15*c* to stretch or contract the inserting/retracting mechanism 7 into the inserted position or the retracted position.

Pulling of the cable 11 by operation of the pedal 9 causes the second arm 15 to rotate about the stand end 15*a*, the joint end 15*b*, and the joint position 15*c*. This causes the first arm 13 to rotate about the joint end 13*b*, about the percussion instrument end 13*a*, and about the joint position 13*c* to effectively stretch the inserting/retracting mechanism 7 causing the percussion instrument 3 to move horizontally away from the stand 5 to the inserted position.

Releasing of the cable 11 by operation of the pedal 9 causes the second arm 15 to, in opposite direction as in the inserting, rotate about the stand end 15*a*, the joint end 15*b*, and the joint position 15*c*. This causes the first arm 13 to rotate about the joint end 13*b*, the percussion instrument end 13*a*, and the joint position 13*c* to effectively contract the inserting/retracting mechanism 7 causing the percussion instrument 3 to move horizontally towards the stand 5 to the retracted position.

In one embodiment (not shown), the inserting/retracting mechanism 7 includes a spring configured in the inserting/retracting mechanism 7 to bias the inserting/retracting mechanism 7 towards retraction (i.e., in the retracted position). In this embodiment, pulling of the cable 11 by operation of the pedal 9 defeats tension force in the spring extending the spring and causing the second arm 15 to rotate about the stand end 15*a*, the joint end 15*b*, and the joint position 15*c*. This causes the first arm 13 to rotate about the joint end 13*b*, the percussion instrument end 13*a*, and the joint position 13*c* to effectively stretch the inserting/retracting mechanism 7 causing the percussion instrument 3 to move horizontally away from the stand 5 to the inserted position. Releasing of the cable 11 by operation of the pedal 9 allows tension force in the extended spring to retract the inserting/retracting mechanism 7 into the retracted position such that the percussion instrument 3 is moved horizontally towards the stand 5.

Figure 12:
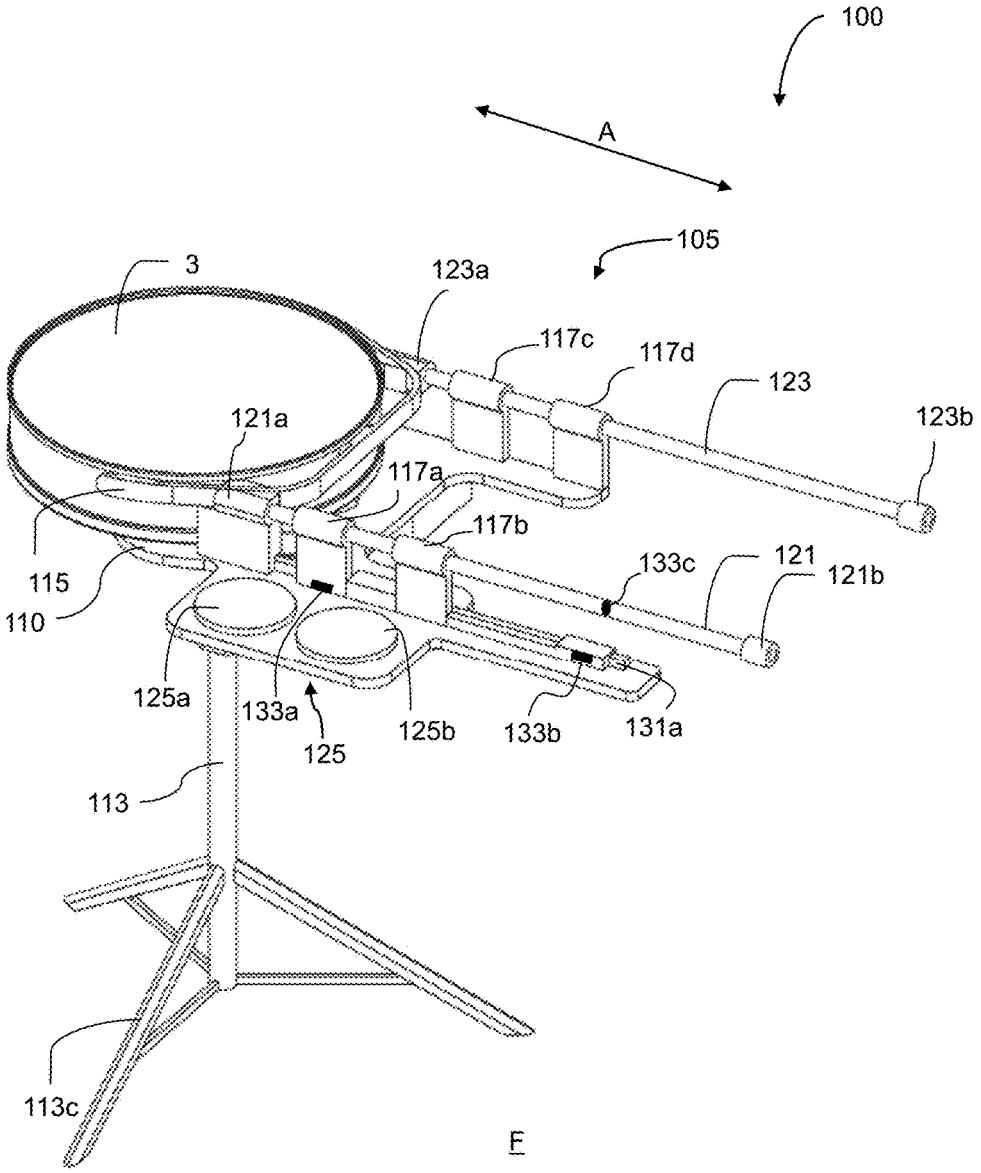
FIG. 12 illustrates a perspective top view of an exemplary insertable percussion system in the retracted position.
Figure 13:
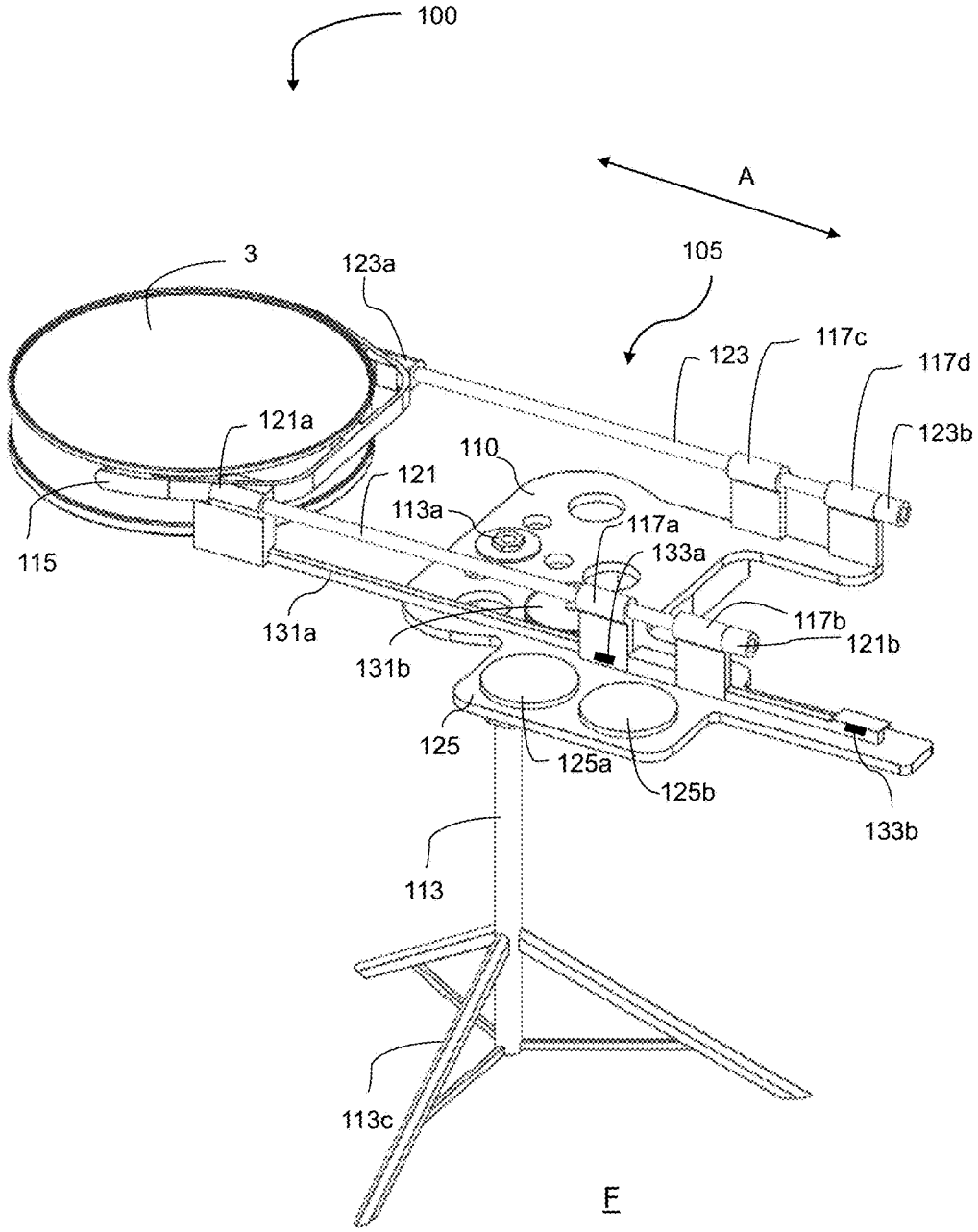
FIG. 13 illustrates a perspective top view of the exemplary insertable percussion system of FIG. 12 in the inserted position.
Figure 14:
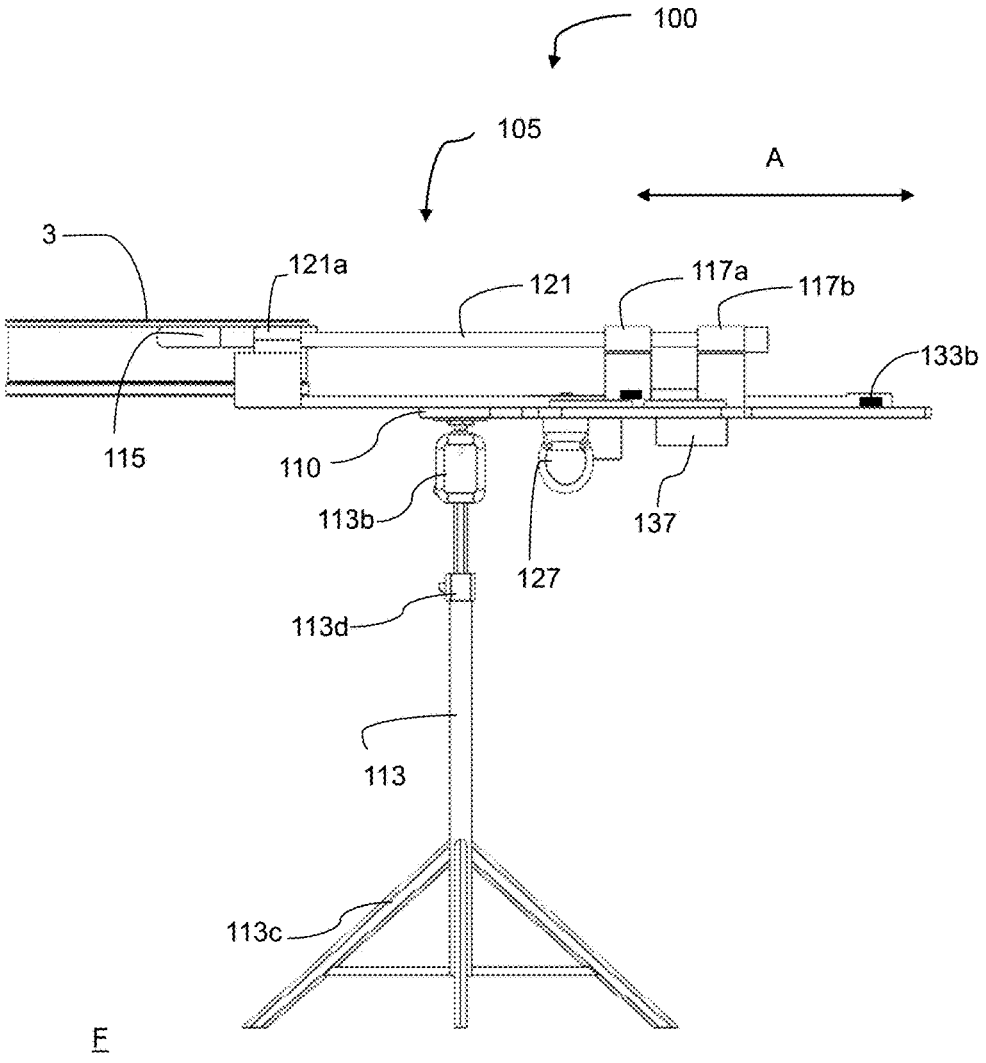
FIG. 14 illustrates a side view of the exemplary insertable percussion system of FIG. 12 in the inserted position.

FIG. 12 illustrates a perspective top view of an exemplary insertable percussion system 100 in the retracted position. FIGS. 13 and 14 illustrate perspective top and side views of the exemplary insertable percussion system 100 in the inserted position. The system 100 may include the percussion instrument 3, an inserting/retracting mechanism 105, and a stand 113.

The inserting/retracting mechanism 105 may include a base 110, a first arm 121 and a second arm 123. The base 110 operably couples the first arm 121 and the second arm 123 to the stand 113. The first and second arms 121 and 123 have percussion instrument ends 121*a* and 123*a*, proximate the percussion instrument 3 and free end 121*b* and 123*b* distal the percussion instrument 3. The percussion instrument ends 121*a* and 123*a* may be coupled to a holding element 115, e.g., a U-shaped metal or plastic rod, which attaches to the side surface of the percussion instrument 3. The holding element 115 couples the percussion instrument 3 to the inserting/retracting mechanism 105. The first and second arms 121 and 123 may slide through the bushing elements 117*a-d* of the base 110 in the directions shown by the arrow A.

The inserting/retracting mechanism 105 may include an input device 125, a motor 127, a gear mechanism 131, and a feedback mechanism 133.

The input device 125 may include one or more switching elements (e.g., touch pads) 125*a* and 125*b*, for receiving an operation instruction and generating an operation signal to activate the inserting/retracting mechanism 105. For example, a hit (using a beater or drum stick) on switching element 125*a* may correspond to an instruction to insert the percussion instrument 3 while a hit (using a beater or drum stick) on switching element 125*b* may correspond to an instruction to retract the percussion instrument 3. In another example, a first hit (using a beater or drum stick) on switching element 125*a* may correspond to an instruction to insert the percussion instrument 3 while a second hit (using a beater or drum stick) on switching element 125*a* may correspond to an instruction to retract the percussion instrument 3. In yet another example, the input device may be disposed near the floor F such that it may receive an operation instruction in the form of a user/player pressing the one or more switching elements with her foot.

The inserting/retracting mechanism 105 may also include a controller 137. The controller 137 may receive the operation signal from the input device 125 and determine the current position of the percussion instrument 3 by use of the feedback mechanism 133.

The feedback mechanism 133 may include Hall-effect sensors 133*a* and 133*b* disposed on the base 110 and a permanent magnet 133*c* disposed on the first arm 121. The feedback mechanism 133 determines the position of the first arm 121 along its travel relative to the base 110 and, thus, the position of the percussion instrument 3. For example, when the permanent magnet 133*c* is aligned with the Hall sensor 133*b*, the percussion instrument 3 may be at or in proximity, e.g., 5-10 cm, to the retracted position. See FIG. 1. On the other hand, when the permanent magnet 133*c* is aligned with the Hall sensor 133*a*, the percussion instrument 3 may be at or in proximity, e.g., 5-10 cm, to the inserted position. See FIG. 2. The sensors 133*a* and 133*b* generate feedback signals corresponding to whether the percussion instrument 3 is in the inserted position, the retracted position, or somewhere in between. The controller 137 generates a command signal based on the operation signal and the feedback signal. For example, if the percussion instrument 3 is at the inserted or retracted position, the controller 137 may stop the motor 127. If, instead, the percussion instrument 3 is merely in proximity to the inserted or retracted position as detected by the feedback mechanism 133, the controller 137 may cause the motor 127 to slow down and eventually stop when the percussion instrument 3 reaches the inserted or retracted position.

The controller 137 may be a microcontroller PIC 12F683 manufactured by Microchip Technology Inc. of Independence, Ohio. However, the controller 137 may include any type of controller sufficient for receiving and generating the above-described signals. The Hall-effect sensors 133*a* and 133*b* may be micro-power ultra-sensitive Hall-effect switches manufactured by Allegro MicroSystems, LLC of Worcester, Massachusetts. However, the Hall-effect sensors 133*a* and 133*b* may be any other type of Hall-effective sensors sufficient for detecting the permanent magnet 131*c* and generating the above-described signals. Indeed, the feedback mechanism 133 may include any other type of sensors suitable for detecting relevant position information.

Figure 15:
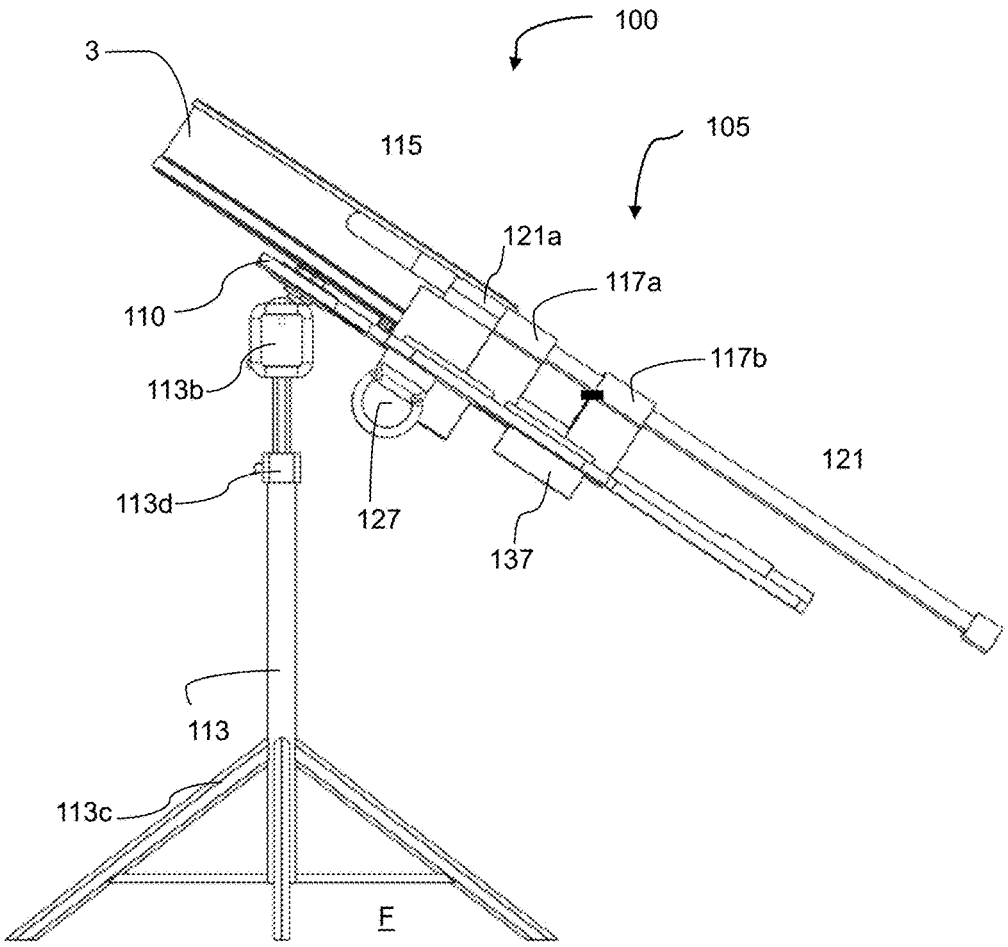
FIG. 15 illustrates a side view of the exemplary insertable percussion system of FIG. 12 in the retracted position set at an angle different from horizontal.

The stand 113 supports and sustains the percussion instrument 3 and the inserting/retracting mechanism 105 vertically off the floor F. The stand 113 may include a fixing element 113*a* that couples to the inserting/retracting mechanism 105. The stand 113 may also include a joint 113*b*, a base 113*c*, and a latch 113*d*. The joint 113*b* may allow for the inserting/retracting mechanism 105 and the percussion instrument 3 to be adjusted and set at an angle different from horizontal and for collapsing the system 100 for storage. See FIG. 15. Thus, the inserting/retracting mechanism 105 may insert and retract the percussion instrument 3 along an axis different from horizontal. The stand 113 may also be telescopic for height adjustment. The latch 113*d* may be used to secure the height of the stand 113.

The gear mechanism 131 may include a rack 131*a* and a pinion 131*b*. A shaft (not shown) of the motor 127 may be operably coupled to the pinion 131*b* of the gear mechanism 131 so as to actuate the pinion 131*b* to turn in a direction to cause a linear actuation of the rack 131*a* in the directions shown by the arrow A. The motor 127 receives the command signal and actuates the gear mechanism 131. The rack 131*a* is fixedly coupled to the first arm 121 (or the second arm 123) of the inserting/retracting mechanism 105 so that the first arm 121 may slide through the bushings 117*b* and 117*c* as the rack 131*a* pushes or pulls the percussion instrument 3. The second arm 123 moves in unison with the first arm 121.

Figure 16:
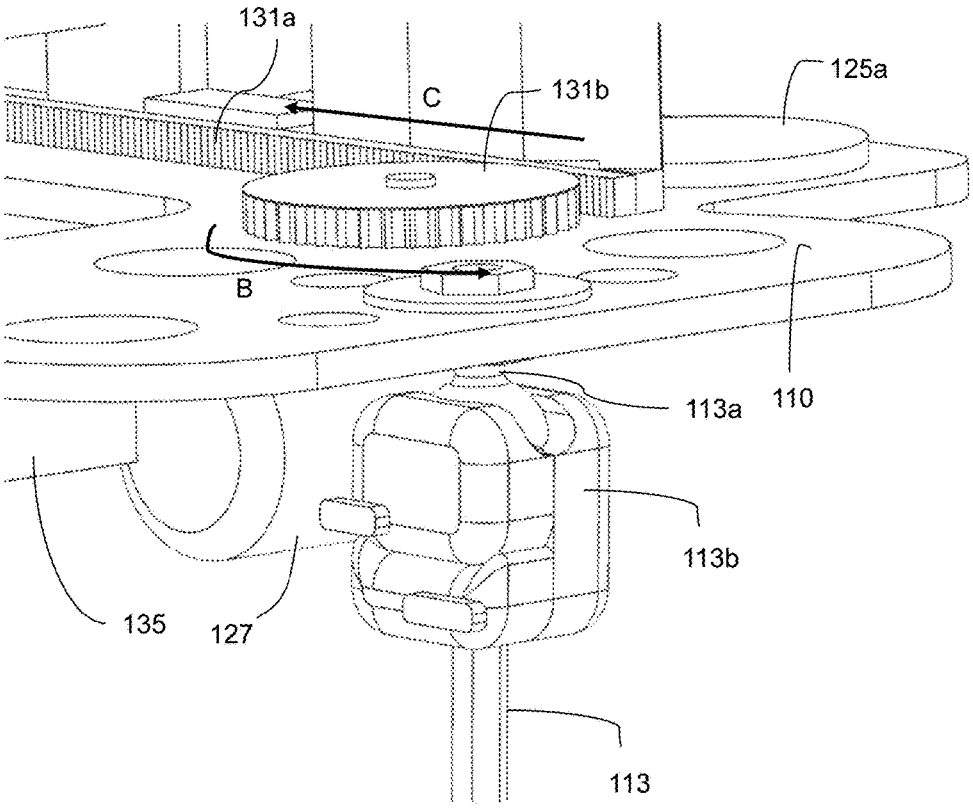
FIG. 16 illustrates an enlarged view of the exemplary insertable percussion system of FIG. 12.

FIG. 16 illustrates an enlarged view of the base 110, the gear mechanism 131, and the stand 113 with the percussion instrument 3 in the retracted position. The shaft (not shown) of the motor 127 may be operably coupled to the pinion 131*b* so that the pinion 131*b* rotates to cause the rack 131*a* to linearly actuate. For example, the controller may cause the motor 127 to rotate in a direction to actuate the pinion 131*b* to rotate counter-clockwise as shown by the arrow B. The pinion 131*b* then causes the rack 131*a* to actuate linearly as shown by the arrow C. As the rack 131*a* moves, the first and second arms 121 and 123 slide in the same direction, moving the percussion instrument 3 from the retracted position to the inserted position. Reverse operation of the motor 127 actuates the gear mechanism 131 in the opposite direction moving the percussion instrument 3 from the inserted position back to the retracted position.

Figure 17:
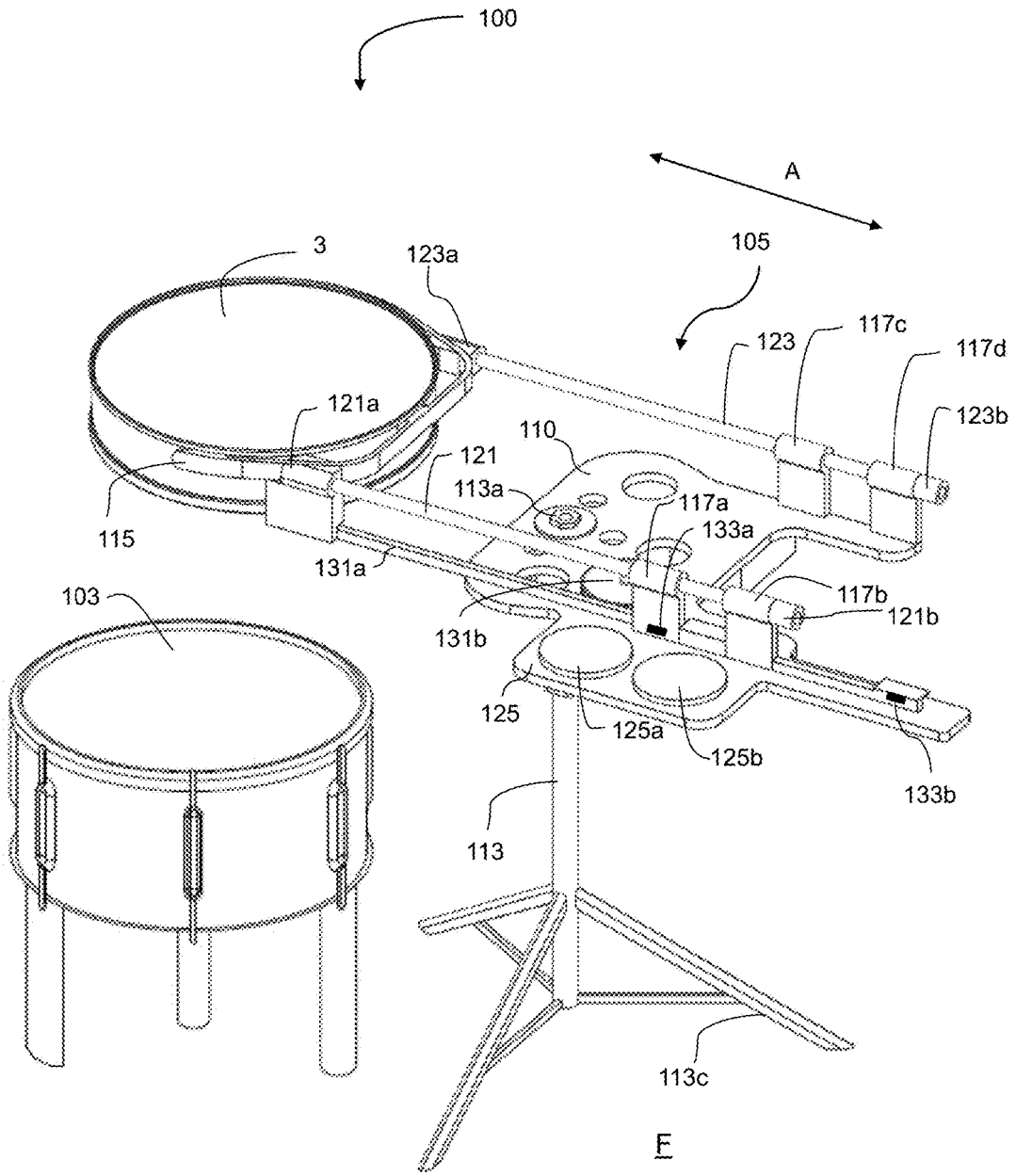
FIG. 17 illustrates a perspective view of the exemplary insertable percussion system of FIG. 12 forming part of a drum or percussion set.

FIG. 17 illustrates a perspective view of the exemplary insertable percussion system 100 of FIG. 12, forming part of a drum or percussion set. In the percussion set, the percussion instrument 3 may be inserted by operation of the motor 127 as described above to make the percussion instrument 3 temporarily available to the percussionist to play. The percussion instrument 3, for example, may be inserted above a second percussion instrument 103 in the percussion set to make the percussion instrument 3 available to the percussionist in addition to the second percussion instrument 103. The inserted position corresponds to a position where a majority of a playing surface of the first percussion instrument 3 faces or vertically overlaps a majority of a playing surface of the second percussion instrument 103. Such a percussion set reduces the playing space, increases variety in sounds played, and thus, increases the enjoyment of play and or listening to performance of the percussion set. As another example, the second percussion instrument 103 may be replaced with another type of instrument. Whenever the percussionist selects to play the other instrument alone, the percussionist may remove or retract the percussion instrument 3 by operation of the motor 127 to make the other instrument available for the percussionist to play.

The term "percussion instrument" as used herein refers to musical instruments in which sound is generally obtained by striking the instrument with hands, beaters, sticks, etc. and their electronic equivalents. Examples of percussion instruments include drums, cymbals, bells, cowbells, hi-hats, tambourines, wood blocks, kettle drums, steel drums, bongo drums, tom-toms, bass drums, tenor drums, snare drums, etc. The term "drum" as used herein corresponds to any type of percussion musical instrument having at least one stretched membrane to generate sound by acoustic vibration when the stretched membrane is struck or their electronic equivalent (e.g., electronic drum pad.)

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components. An "operable connection," or a connection by which entities are "operably connected," is one by which the operably connected entities or the operable connection perform its intended purpose. For example, two entities may be operably connected to each other directly or through one or more intermediate entities.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A drumming system comprising:

a first percussion instrument;

an inserting/retracting mechanism operably connected to the first percussion instrument and configured to move the first percussion instrument along an axis relative to a second percussion instrument from a retracted position to an inserted position and from the inserted position to the retracted position, the inserting/retracting mechanism comprising:

a motor;

an input device operably coupled to the motor and configured to receive operation instructions corresponding to moving the first percussion instrument relative to the second percussion instrument from the retracted position to the inserted position or from the inserted position to the retracted position, and to generate an operation signal based on the operation instruction;

a feedback mechanism operably coupled to the motor and configured to obtain position information of the inserting/retracting mechanism and generate a feedback signal representative of the position information; and a controller operably coupled to the input device, the motor, and the feedback mechanism, the controller configured to actuate the motor based on the operation signal and the feedback signal; and wherein the inserted position corresponds to a position where a majority of a playing surface of the first percussion instrument faces or vertically overlaps a majority of a playing surface of the second percussion instrument.

2. The drumming system of claim 1, comprising:

a stand operably coupled to the inserting/retracting mechanism and having a base.

3. The drumming system of claim 1, wherein the inserting/retracting mechanism includes:

a first arm having a percussion instrument end proximate the first percussion instrument and a free end distal the first percussion instrument;

a second arm having a percussion instrument end proximate the first percussion instrument and a free end distal the first percussion instrument;

a gear mechanism operably coupled to the motor and to at least one of the first arm and the second arm to cause the at least one of the first and second arms to move the first percussion instrument from the inserted position to the retracted position and from the retracted position to the inserted position.

4. The drumming system of claim 1, wherein the motor is operably coupled to a linear actuator.

5. The drumming system of claim 4, wherein the linear actuator includes a gear mechanism.

6. The drumming system of claim 1, wherein the input device includes a touch pad configured to receive the operation instructions in the form of hits from a drum stick, a first hit corresponding to a first operation instruction to move the first percussion instrument from the retracted position to the inserted position and a subsequent hit corresponding to a second operation instruction to move the first percussion instrument from the inserted position to the retracted position.

7. The drumming system of claim 6, wherein the controller determines rotating direction and speed of the motor based on the operation signal and the feedback signal.

8. The drumming system of claim 1, wherein the feedback mechanism includes a magnet and a sensor.

9. The drumming system of claim 8, wherein the sensor is a Hall-effect sensor.

10. The drumming system of claim 1, wherein the first percussion instrument corresponds to an upstroke drum and the second percussion instrument corresponds to a downstroke drum.

11. The drumming system of claim 1, wherein the input device includes a touch pad configured to receive the operation instructions in the form of pressing from a foot of a user or player.

12. A method of drumming comprising:

hitting a pad with a beater or drum stick or pressing the pad with a foot to actuate via a motor an inserting/retracting mechanism to move a first percussion instrument along an axis from a retracted position to an inserted position, wherein the percussion instrument corresponds to an upstroke instrument to be hit by a beater or drum stick with an upstroke or upward motion and a second percussion instrument corresponds to a downstroke instrument to be hit by the beater or drum stick with a downstroke or downward motion, wherein the inserted position corresponds to a position where a playing surface of the upstroke instrument faces or vertically overlaps a playing surface of the downstroke instrument, and wherein the retracted position corresponds to a position where a majority of a playing surface of the upstroke instrument does not face or does not vertically overlap a playing surface of the downstroke instrument; and hitting the second percussion instrument with a drum stick or beater on a downstroke motion and hitting the first percussion instrument with an upstroke motion immediately following the downstroke motion.

* * * * *